US005195298A

United States Patent [19]

Baranowski

[11] Patent Number: 5,195,298

[45] Date of Patent: Mar. 23, 1993

[54] CONTAINER FILLING AND SEALING SYSTEM

[75] Inventor: John Baranowski, Bensalem, Pa.

[73] Assignee: Campbell Soup Company, Camden, N.J.

[21] Appl. No.: 718,384

[22] Filed: Jun. 20, 1991

Related U.S. Application Data

[62] Division of Ser. No. 641,138, Jan. 15, 1991.

[51] Int. Cl.[5] ..... B65B 55/02; B65B 7/28

[52] U.S. Cl. ..... 53/425; 53/471; 53/478; 53/485; 156/69; 156/281; 156/308.4; 156/536

[58] Field of Search ..... 141/91; 15/304, 307, 15/309.1, 309.2; 156/69, 281, 308.4, 536; 53/167, 282, 329.3, 329.4, 329.5, 373.2, 373.7, 425, 426, 432, 471, 478, 485, 510

[56] References Cited

U.S. PATENT DOCUMENTS

| | | | |
|---|---|---|---|
| 2,734,213 | 2/1956 | Ashford | 15/304 |
| 3,037,557 | 6/1957 | Faeber et al. | 15/307 |
| 3,564,812 | 2/1971 | Mueller et al. | 53/282 X |
| 3,597,237 | 8/1971 | Nughes | 53/425 X |
| 3,823,438 | 7/1974 | Webber et al. | 15/309.2 X |
| 3,953,272 | 4/1976 | Webber . | |
| 4,074,619 | 2/1978 | Feliks | 156/69 X |
| 4,260,438 | 4/1981 | Dembicki et al. . | |
| 4,318,431 | 3/1982 | Evans | 141/91 X |
| 4,409,775 | 10/1983 | Brody et al. | 53/167 |
| 4,424,659 | 1/1984 | Perigo et al. | 53/425 |
| 4,448,011 | 5/1984 | Pohl | 53/167 X |
| 4,559,092 | 12/1985 | Oakley | 156/69 |
| 4,588,000 | 5/1986 | Malin et al. | 53/510 X |
| 4,597,242 | 7/1986 | Hendriks et al. | 53/426 |
| 4,771,903 | 9/1988 | Levene et al. . | |
| 5,020,303 | 6/1991 | Vokins | 53/167 X |

*Primary Examiner*—John Sipos
*Assistant Examiner*—Linda B. Johnson
*Attorney, Agent, or Firm*—Banner, Birch, McKie and Beckett

[57] ABSTRACT

After plastic bowls have been filled with soup they are conveyed to a cleaning station. At this station downward needle-like jets of ambient air specifically conforming to the bowl flange surfaces blow contaminants off of the flnages and away from the containers, in either continuous or intermittent operations. Lids are then heat sealed to the cleaned flanges, and the sealed containers sterilized.

16 Claims, 7 Drawing Sheets

26
77
68
42
AIR
R
50
62
52
54
B
44
P
T
61
SOLENOID
53

CONTAINER FILLING AND SEALING SYSTEM

This application is a division of application Ser. No. 07/641,138, filed Jan. 15, 1991.

BACKGROUND OF THE INVENTION

The present invention relates to systems, equipment and methods for filling and sealing containers, with an air-tight fit to thereby form a shelf-stable product after sterilization thereof. The containers can be, for example, plastic bowls which are filled with chunky or clear soups.

Examples of prior art machines for filling and sealing are the GASTI Cup Filling and Sealing Machine Model DOGAtherm 81 as described in the publication entitled "GASTI Dogatherm" and dated Feb. 17, 1984, and the FEMCO Machine, as described in the publication entitled "4-Head Tandem Gas Flush Heat Seal" and dated September, 1988, and illustrated in the drawings entitled "Gas Flush Extension—Model No. 1250—Ser. No. 6469." FEMC is the acronym for Food Equipment Manufacturing Corporation, of Maple Heights, Ohio. These and any other publications, patents or applications mentioned anywhere in this disclosure are hereby incorporated by reference in their entireties.

For both of these machines a continuous, straight line conveying line is provided. Empty containers or packages, such as cups or bowls, are placed in pallets and securely held therein, and conveyed on the conveying line to the filling system, which typically comprises three fill stages. The first is a meat slurry, particulate or ingredient deposit; the second is the vegetable portion deposit; and the third is the broth or water topoff. For products such as chunky clam chowder only a single filling stage or step is needed. The containers are filled approximately ninety percent full of product, as close to the brim as possible. After being filled, the containers are conveyed to the sealing station where lids are placed on the top flange areas thereof and conductive heat sealed thereon. The filled and sealed containers are subsequently sterilized. An example of a sterilzer is the FMC (Food Machine Corp.) Universal Sterilizer, which includes a steam chamber wherein the sealed packages are held for a time sufficient to sterilize the package inside and outside, but not so long as to overcook and degrade the product. The chamber can, for example, be under pressure—twenty-one psi at 250° F.—and the product held therein between an hour and an hour and a half.

The FEMCO and GASTI machines are very similar, and both use similar filling systems. For the FEMCO machine, various numbers of packages can be held in a single pallet. One FEMCO unit has a single line, one package per pallet arrangement, and four sealing heads. The GASTI is a dual line system, with two containers per pallet and in a six-pack arrangement. Thus, the GASTI machine can run at higher speeds than the FEMCO because more, essentially twice, the number of packages are being sealed.

Two methods of sealing lids to the filled containers are known in the prior art. One uses a lid which has been previously dome shaped and cut to the container configuration, positions the pre-cut lid on the container and compresses and heat seals it thereon. The lid can be formed of aluminum foil polypropylene or polyethylene material. Both the FEMCO and GASTI units use this pre-cut lid deposit technique. A second method is a continuous foil lid operation where a sheet of foil is placed on the bowl flange, and a blade is lowered down and cuts or serates the excess foil off, thereby shaping the lid to the bowl, as the foil is compressed and heat sealed to bowl. With either of these techniques and prior to fusing the lid material to the bowl flange, a vacuum can be pulled out according to the prior art and nitrogen gas injected into the bowl as the lid is placed on top of the bowl and immediately prior to sealing. In other words, a vacuum is pulled out, inert gas is injected under the lid into the package and the lid then heat sealed in place.

After the lid has been sealed to the container, the sealed package is put through a sterilization process. This gives the package a shelf life of a year to two and a half years without loss of flavor. Examples of products made by this system are those available from Campbell Soup Company of Camden, N. J., including their "Microwavable Chunky Soup—Ready To Serve," which comes in five varieties—sirloin burger, chicken, old fashion chicken, clam chowder and beef noodles.

During the filling stage and as additional product is added into the package, container or bowl the target area or depth in the container gets smaller. Meats, vegetables and other contaminants are thereby more likely to be deposited on the flange area of the containers. Further deposition results from the splashing caused when the frozen or heated products impact one another and also from condensation droplets.

When contaminants or any other particulates are on the flange, a perfect seal and fusion of the lid thereto cannot be guaranteed. The seals of the present product are not the same as those found on many frozen products wherein the seal functions essentially as a dust cover. Rather, heating or fusing is used therein to provide a perfect air-tight seal. After the seal is on, the package is sterilized as previously described and a shelf-stable product created. An air-tight seal is created keeping the contents inside of the package sealed and not allowing anything else to get into the package or the contents thereof to spoil. Additionally, during sterilization of the sealed package, lid and/or flange expansion and contraction can occur, and if there is not a good fusion and a good seal, the seal can open. In other words, even if a seal is made around the entire perimeter of the flange initially, the seal may release itself at a later date, if there are any particulates or liquids on the flange area. If the seal releases, the opening thereby formed can result in the particulates, liquids and ingredients decaying or otherwise contaminating the product, or allowing foreign materials into the package.

Removal of the contaminants from the container flange after the filling stage and before the sealing stage can thus be critical. In the past this has been done manually. One or more workers are positioned along side the conveying line and as the filled containers pass by them, the workers manually wipe the flanges off with paper towels. This manual cleaning process is obviously labor intensive and thus expensive and slow, and perfect cleaning cannot always be guaranteed.

A process for sealing glass bottles is disclosed in U.S. Pat. No. 4,771,903. When these bottles are filled with wet, pulpy material such as orange juice, grapefruit juice and tomato juice, the pulpy semi-solid residues on the container rim can reduce the effectiveness of the seal closure. Mention is made in that patent that to reduce the amount of pulpy residue from the rim prior to sealing a post-heat treatment can be used. This heat treatment renders the rim surface more hydrophobic, and the pulpy liquids and solids are thus less likely to stick to the rim and more likely to be squeezed out from between the surfaces during the sealing process. The preferred cleaning method disclosed in that patent, however, subjects the container rim to a fluid stream directed across the surfaces of the rim. The stream comprises an intermittent jet of stream or hot air directed inwardly or horizontally across the flange. This cleaning method avoids physical wiping or brushing of the rim to remove the pulpy residues which in itself can lead to contamination and does not provide as complete a hermetic sealing surface. A plastic cap, instead of metal foil seals of the type shown in U.S. Pat. No. 4,260,438, are then applied to the bottle rim.

SUMMARY OF THE INVENTION

Accordingly, it is a principal object of the present invention to provide a system for effectively sealing containers filled with liquid and particulate products. In other words, an improved means for quickly and efficiently cleaning the flange surfaces of bowls or the like filled with soups or the like before heat sealing of the lid thereto is desirable.

Directed to achieving this object, an improved filling and sealing system is herein disclosed. The system is particularly adapted for filling plastic bowls or cups having wide flange areas with soup, broth or paste. After filling and before sealing foil lids to the flange surfaces, the flange surfaces are automatically cleaned. They are cleaned with jets of air at ambient temperature directed generally downwardly at the flange and through a pattern of slotted orifices configured to match the flange seal surface areas of the containers. According to one embodiment hereof, air is passed in a continuous operation through a slot in a stationary manifold and through the orifices of a template or rotating sleeve when the orifices intersect the narrow curtain of air passing out through the slot. As the sleeve rotates and the slots track directly beneath the air curtain, narrow air blasts are formed by the angle and location of the slots, thereby directing the air only at the traveling containers' flange surfaces. The air blows the contaminants off and away from the flange without disturbing the container or its contents, leaving a clean surface ready for heat sealing. The rotating pattern sleeve is accurately timed and synchronized with the center line distance and spacing of the containers conveyed therepast. For a stationary operation instead of a continuous operation, the template can comprise a flat instead of a round or cylindrical surface. The template or head is lowered down over the package, which remains stationary for a preset time, and blows the particulates away from the seal surfaces of the package.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
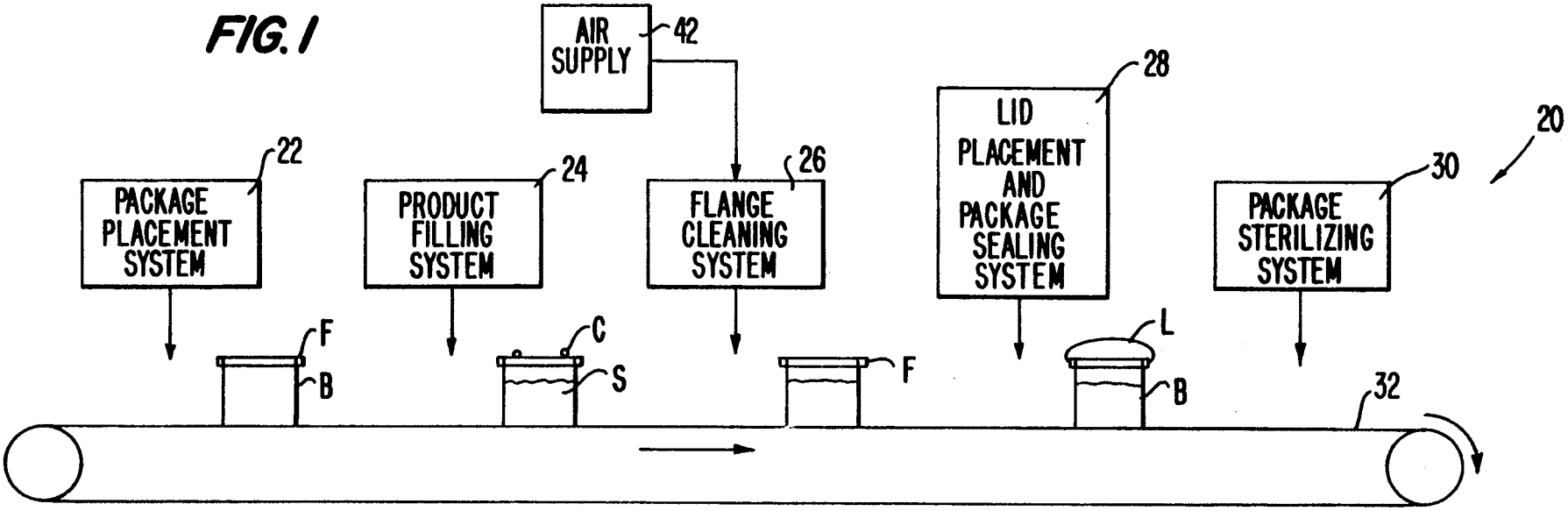
FIG. 1 is a schematic view of a first filling and sealing system of the present invention.
Figure 8:
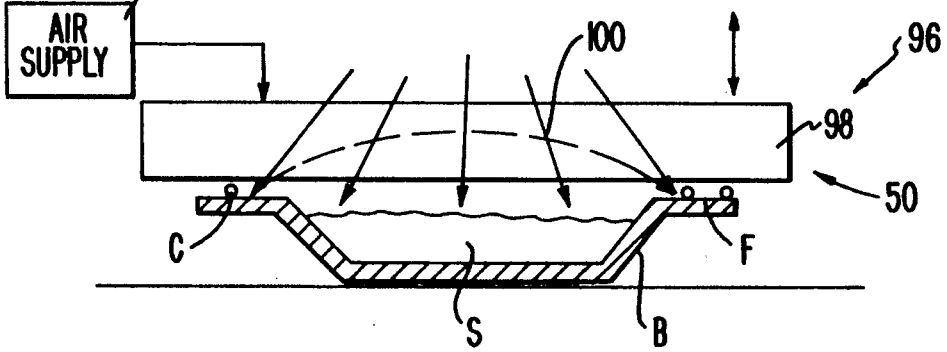
FIG. 8 is a schematic view of a second flange cleaning system of the present invention showing an indexing operation.

Referring to FIG. 1 a filling and sealing system of the present invention is illustrated schematically and generally at 20. System 20 includes a package placement system 22, a product filling system 24, a flange cleaning system 26, a lid placement and package sealing system 28, and a sealed package sterilizing system 30, positioned in that order and along a conveyor 32. The lid placement system 28 can include pre-cut lid or continuous roll feed lid stock equipment for placing lids L on the flanges F. When the bowls or containers B with their flanges F are placed in the pallets P at the package placement system 22, they are securely held therein such that they cannot move or rotate as can be understood from FIG. 5. With the exception of the flange cleaning system 26, the system 20 of FIG. 1 can be either of the previously-discussed FEMCO or GASTI machines, modified as would be apparent to those skilled in the art from this disclosure. In other words, the flange cleaning system 26 of the present invention can be constructed and mounted to an existing FEMCO (or GASTI) machine between the filling and the sealing stations (24 and 28) thereof. While the flange cleaning system 26 of FIGS. 1–7 is a continuous system, that of FIG. 8 is an intermittent or indexing system, as will be explained in detail later.

Simply, the flange cleaning system 26 of FIG. 1 includes a Delrin air manifold 40 communicating at one end with the supply of filtered plant air 42 and having a downwardly disposed, longitudinal slot 44. This slot 44 is positioned above the conveyor 32 and directed down onto and perpendicular thereto. If unobstructed, a narrow curtain of pressurized air would flow down through the slot 44 onto and across the conveyor 32. Such air curtain, however, with a bowl B filled with product P passing therebeneath would disturb the contents of the bowl, likely kicking them up onto the flange F and further contaminating the flange, and would not efficiently blow the contaminants on the flange off of it and away from the interior of the bowl.

Accordingly, the present invention includes a template 50 having a pattern of openings 52 therethrough. The template 50 is positionable between the manifold slot 44 and the bowls B, that is, within the curtain of air. A preferred construction of this template 50 is as a cylindrical, stainless steel sleeve 54 (FIG. 6) disposed and rotatable about the manifold 40. The sleeve 54 has a pattern of the slots (or openings) 52 therethrough shaped, for example, generally in an oval shape, as can be understood from FIGS. 5–7. The sleeve 54 is rotated about the manifold 40 in a carefully coordinated and synchronized manner by a synchronizing drive shown generally at 60 in FIGS. 2 and 3. This rotation corresponds to the movement of the conveyor 32, or in other words the movement of the bowls B held in the pallet supports P riding on the conveyor 32.

The narrow air blasts are determined by the angle and location of the slots 52, directing the air only at the flange surfaces F of the containers B passing therebeneath. The pattern of openings 52 of the rotating sleeve 54 accurately tracks with the center line distance and spacing of the containers B. The air pattern blows the contaminants C (FIG. 1) off of the flanges F without disturbing the container B or its contents S (such as chunky soups) and thereby leaving a clean surface to be heat sealed. (See U.S. Pat. No. 3,953,272, which in column 3, line 35, mentions blowing hot air to clean the inner surfaces of a sack, which are to be heat sealed together later.)

The slotted orifice or pattern of openings 52 of the sleeve 54 can thus be angled by manually rotating the manifold 40, and by the rotation of the sleeve track the movement of the container B. As it tracks the container B, it blows the contaminants C either backwards or if the orifice is angled, it blows them out to the side away from the product S inside the container. The air entering the manifold 40 and forming the air curtain is clean, dry ambient pressurized air from the plant air supply (42) and at plant pressure. The air is on constantly inside of the manifold 40 and escapes only when the sleeve 54 rolls around and the slot orifices 52 cross or intersect the path of the air curtain. When the system 20 is not in operation, the flow of air from the plant supply 42 to the manifold 40 can be shut off by solenoid 53, depicted in FIG. 5. Thus, when the entire system 20 is to be shut down as when it is to be periodically steam cleaned, it is desirable to shut off the supply of air from air supply 42 to the manifold 40. A valve or switch is thus provided which when activated electronically shuts off the solenoid 53 to block the flow of air.

The orifices 52 are only a couple of thousandths of an inch in the air path thereby defining only fine needles of air to accurately and precisely impact the flange F and at the proper angle and blow the contaminants C away from the product S in the containers B. Two tracks of air in this oval design are created going contra with the flange F, as can be understood from FIG. 5 for example. As an example, if in a single lane machine (20), fifty containers (B) per minute pass by the curtain then each container is exposed to the curtain for approximately 1.1 seconds. Pressures of air between five pounds per square inch and fifty pounds per square inch are within the scope of this invention. For chunky soup products (S) a preferred pressure is twelve pounds per square inch. With this automated cleaning system 26 the conveying line can be run generally ten percent faster than that of the prior art. For example, instead of ninety feet per minute it can be run at one hundred feet per minute.

Figure 5:
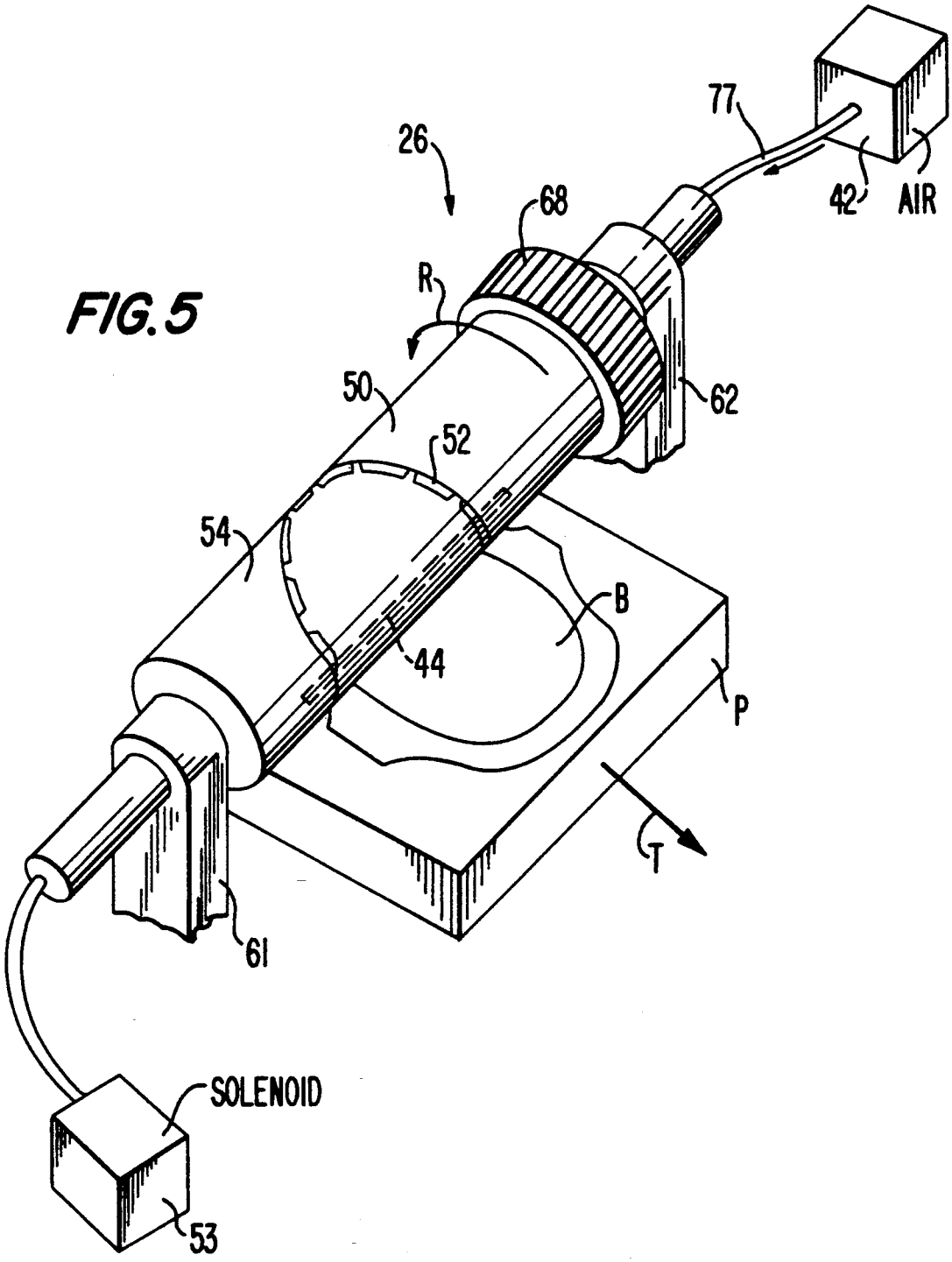
FIG. 5 is a simplified perspective view of the manifold assembly of FIG. 4, modified slightly and showing a loaded pallet passing underneath thereof.

Referring to FIG. 5, container flange surfaces F that are positioned above or flush with the tops of the horizontal surface of the pallet P are thereby cleaned. Different pallets P are used for differently-shaped containers. Some of the pallets P have anvils, wherein the flange F is slightly above that surface. The anvils comprise recesses in the surface of the pallet P to support the bowls B under their flanges F. Thus, during heat sealing of the lid placement and package sealing system 28, pressure is applied on the lid L and the bowl B only at the flange F. The container B is not damaged and is maintained rigid, and there is no heat loss through the container. In another case, the flange F is even with the surface so that the bowl B sits inside of the pallet P and the top flange F of the bowl is flush with the pallet.

Figure 2:
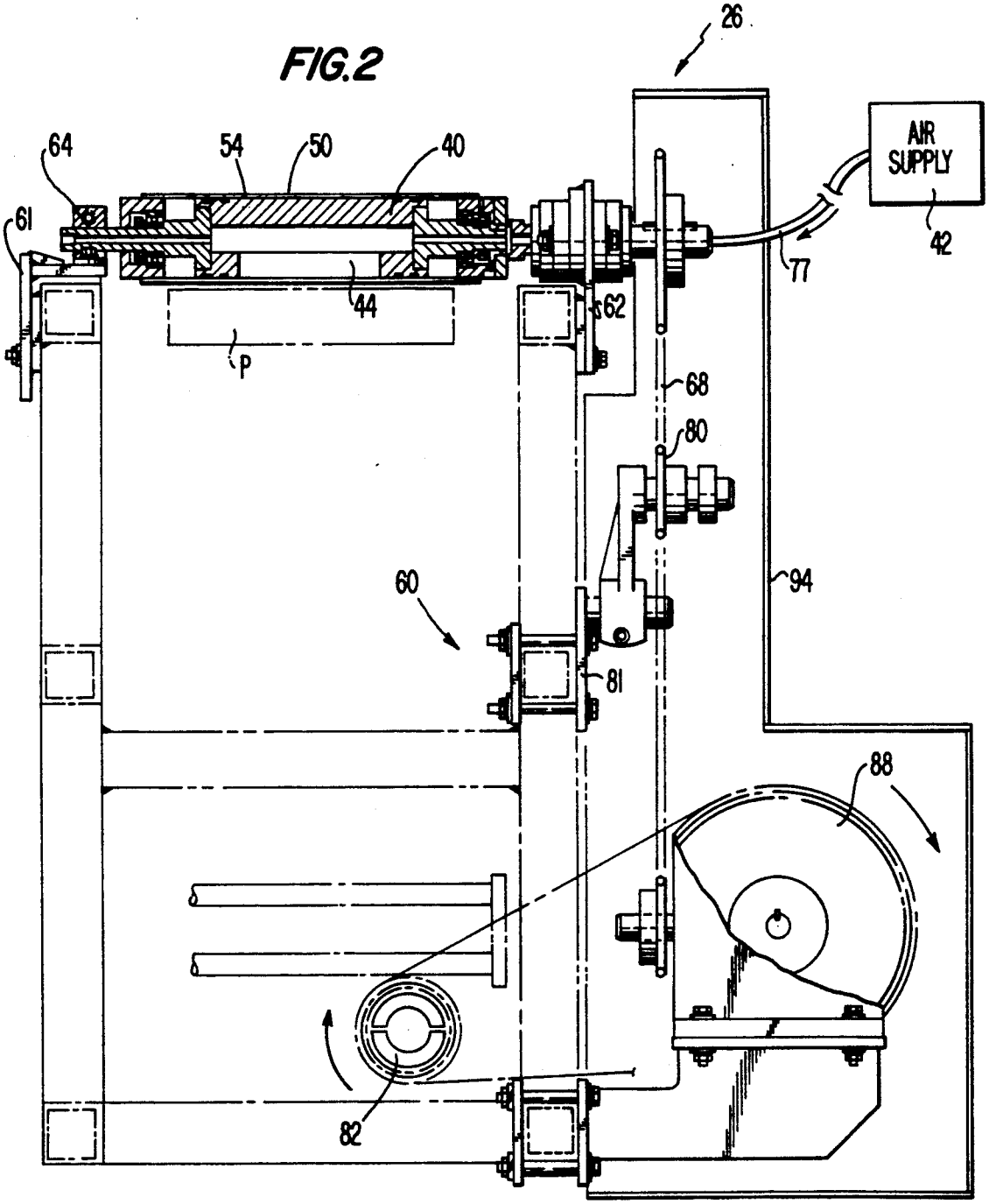
FIG. 2 is a cross sectional view of the flange cleaning system of the system of FIG. 1.
Figure 3:
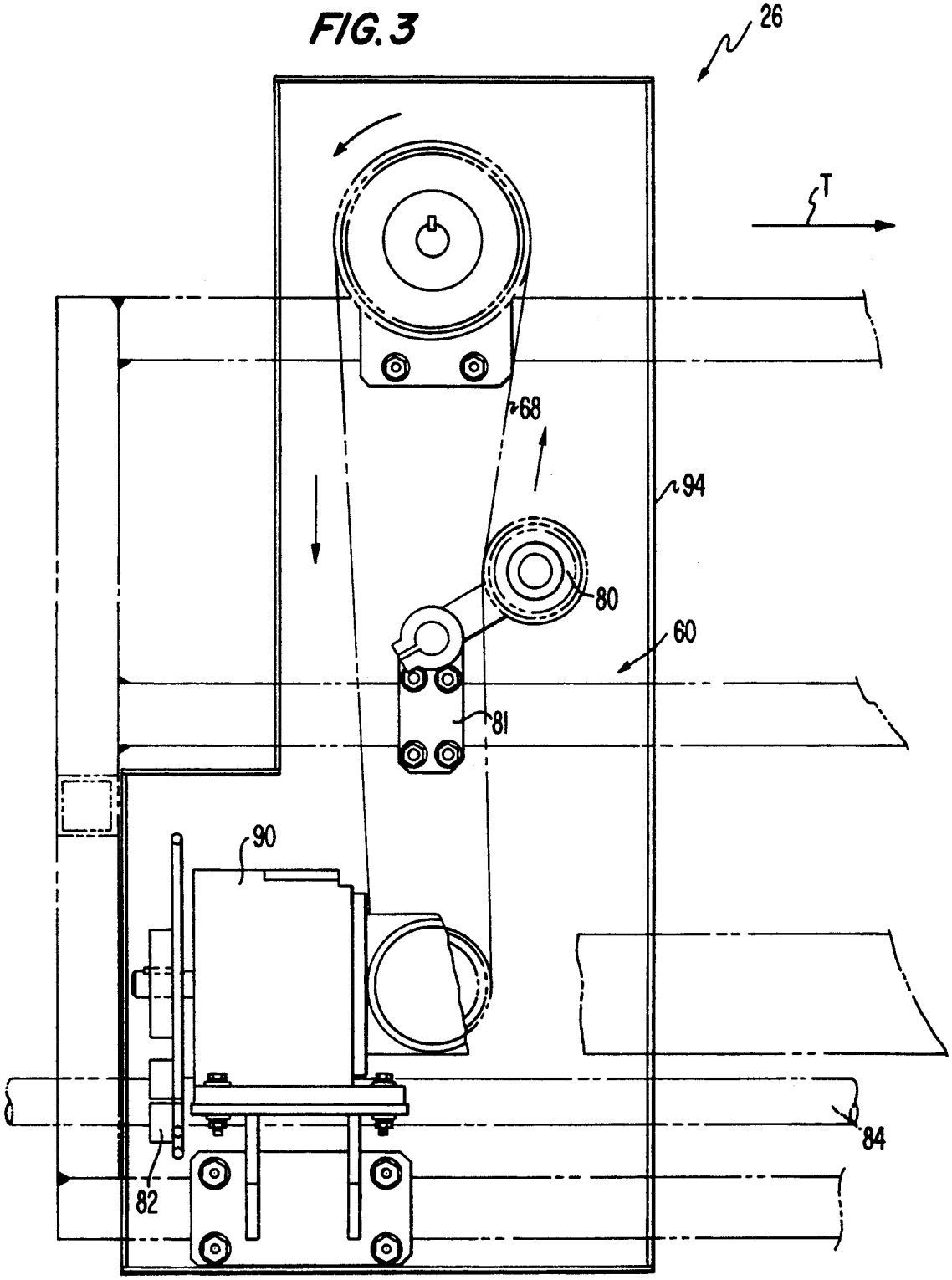
FIG. 3 is a longitudinal sectional view of the flange cleaning system of FIG. 2.
Figure 4:
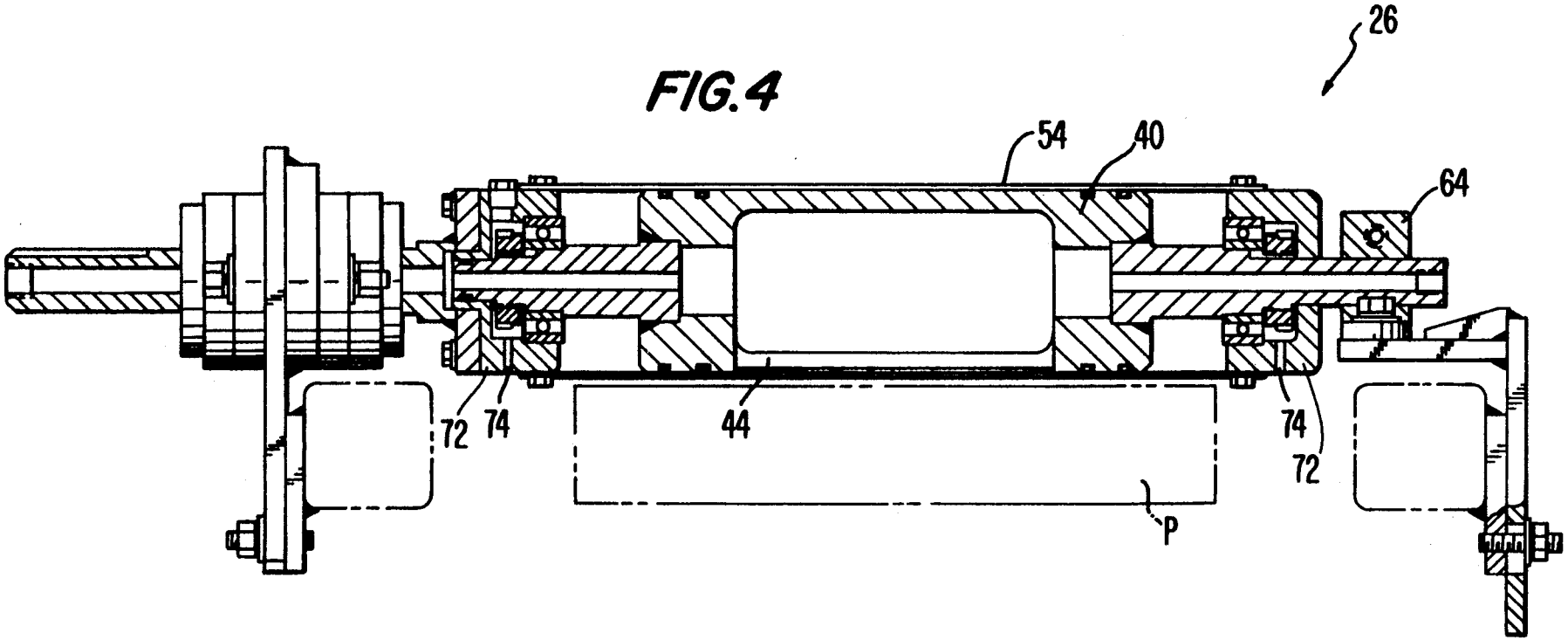
FIG. 4 is an enlarged, cross sectional view of the opposite side of the manifold assembly of the flange cleaning system depicted in FIG. 2.

Reference is hereby made to FIGS. 2–5 showing details of the construction of a preferred flange cleaning system 26 mounted to an existing FEMCO machine. In FIGS. 2–4, the structure illustrated with phantom lines conveniently represents existing FEMCO machine structure. The flange contaminant removal assembly or the cleaning system 26 is shown mounted by end frames 61, 62 to the framing of the existing machine. The manifold 40 is clamped fixed in place by clamp 64 to the frame, and the sleeve 54 is then rotatable about the manifold. The sleeve 54 is rotated by a drive chain or timing belt 68 whose speed is synchronized by drive 60 with the speed of the conveyor 32.

One side of the air manifold 40 is thus fixed by the clamp 64, and the other side is connected to the drive chain 68 which then rotates the sleeve 54 about the manifold 40 and with respect to the air curtain slot 44 of the manifold. This slot 44, which is approximately 0.12 inch wide and five inches long, can be angled to any angle perpendicular to the package or bowl B, by manually rotating the manifold 40, thereby blowing the particulates C backward or forward as desired. Again, the air is continuously blowing down through the slot 44 and as the orifices 52 of the sleeve 54 rotate and intersect or cross the curtain, pressurized air is supplied in a needle-like manner down to and along the flange F of the container B passing therebeneath. The flange surface F is thereby cleaned progressively under the manifold 40 as it is conveyed therepast by the conveyor 32.

Figure 6:
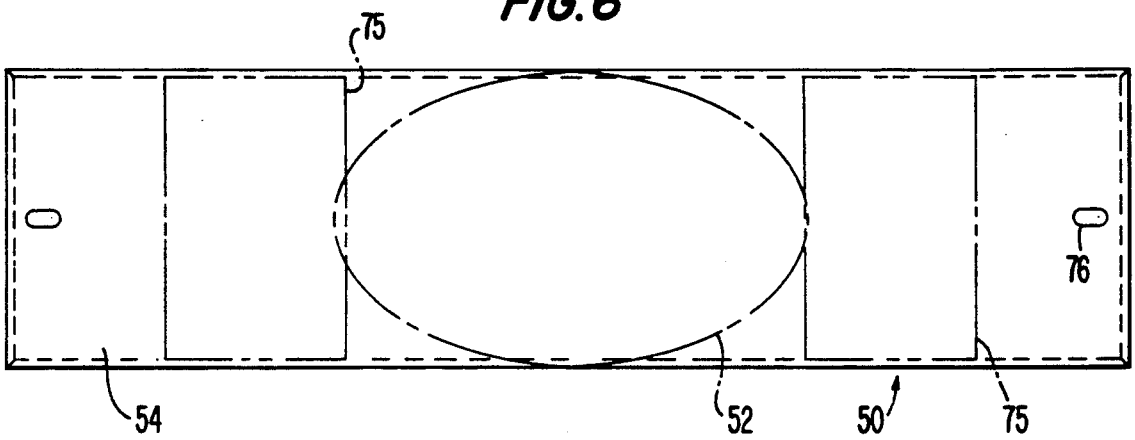
FIG. 6 is a plan view of the sleeve of FIGS. 2–4 illustrated in isolation.
Figure 7:
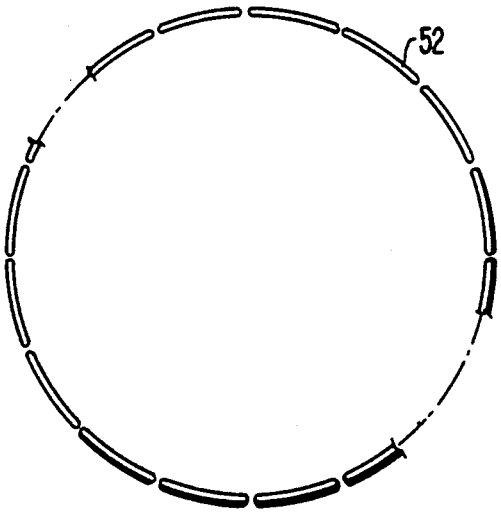
FIG. 7 is an enlarged view showing the orifice pattern of the sleeve of FIG. 6 in a laid flat position.

Bolts can be removed and the manifold 40 slid out of the sleeve 54 for ease in replacing the bearings and seals as shown in FIGS. 2–4. The holes for these bolts are shown in FIGS. 2 and 4 for example, and the bearing mounts are shown generally at 72. Grease for lubricating the bearings can be conveniently injected in through the grease fittings 74. FIG. 6 shows alignment marks 75 to aid in accurate reassembly and orientation of the drum or sleeve. The elongated end holes 76 are provided for bolt screws or for the grease fittings 74.

An air hose 77 communicating with the plant air supply 42, which includes a regulator and filter, is connected to one end of the shaft of the assembly. A series of o-rings retain the air in the manifold 40. Although air could be provided to both sides of the manifold 40 and an elaborate rotatable fitting (not shown) provided allowing the hose (76) to be stationary and the shaft to rotate, such is not needed. Air coming in through only one end of the manifold 40 has proven in tests to be sufficient.

The chain idler 80 is held by a clamp 81 to the frame of the machine. A snap ring collar sprocket 82 that goes around the main shaft 84 of the machine is shown on the left hand side of FIG. 3 and is driven off of main shaft 84. The drive chain 68 is parallel to the line of the flange cleaner and goes down to the right angle drive 88 and a gear box and phase changer 90. A protective stainless steel housing 94 slides over the top of the equipment so that hands and other objects do not get caught in the equipment.

In other words, the horizontally mounted manifold 40 creates a narrow curtain of clean air downward across a passing product-filled container B. The sleeve 54 revolves around the air manifold 40, one revolution per container B as shown by the arrow R and relative to the container's direction of travel, as shown by the arrow T in FIG. 5. The sleeve 54 has a pattern or template of slotted orifices 52 arranged to match the sealing surface area of the container or bowl flange F. The configuration of slotted orifices and pattern sleeve diameters can be readily adapted to various container lengths, widths and heights. Air passes through the stationary manifold 40, through the orifices 52 of the rotating pattern sleeve 54 when the orifices intersect the narrow curtain of air. As the sleeve 54 rotates and the slots 52 track directly beneath the air curtain, narrow air blasts are created directing the air downward and at angles, if needed, and only at the traveling container's flange surface F. The contaminants C are blown off of the flange F without disturbing the container B or its contents S, leaving a clean surface ready for heat seal. The rotation of the pattern sleeve 54 is accurately synchronized by drive 60 with the conveyance movement and spacing of the containers B. Timing and rotation are mechanically achieved by a chain and sprocket drive 68 with the phase changer 90 connected to the conveyor's main shaft drive 84.

When the bowls B come down the line on this machine, they are in line in the direction of travel and traveling at about one hundred containers per minute. The pallets P themselves are driven by the chain, and as the machine wears the chain stretches. The phase changer 90 allows, by turning the knob thereof, to bring the system back on center again. That is, it can be brought back into phase so that the templates 40 are timed with the movement of the pallets P.

EXAMPLE

A test using fifty filled and contaminated plastigon bowls was performed. Conveyor pallet guide rails were installed for continuous horizontal/perpendicular alignment of bowls to the pattern sleeve. The contaminants used were various sizes of beef, beef broth and different consistencies of tomato paste arranged around the bowl flange. The containers were run under the contaminant remover (flange cleaning system) at fifty containers per minute and with an air pressure of twelve pounds per square inch. Visual inspection showed low viscosity droplets less than ⅛ of an inch in diameter and that the thin strands of meat had been completely removed. Thick droplets of ⅛ of an inch diameter and larger were dispersed into smaller droplets with some remaining on the flange, however. Placing the bowls with the remaining small droplets under the cleaning device again effected complete removal.

Figure 9:
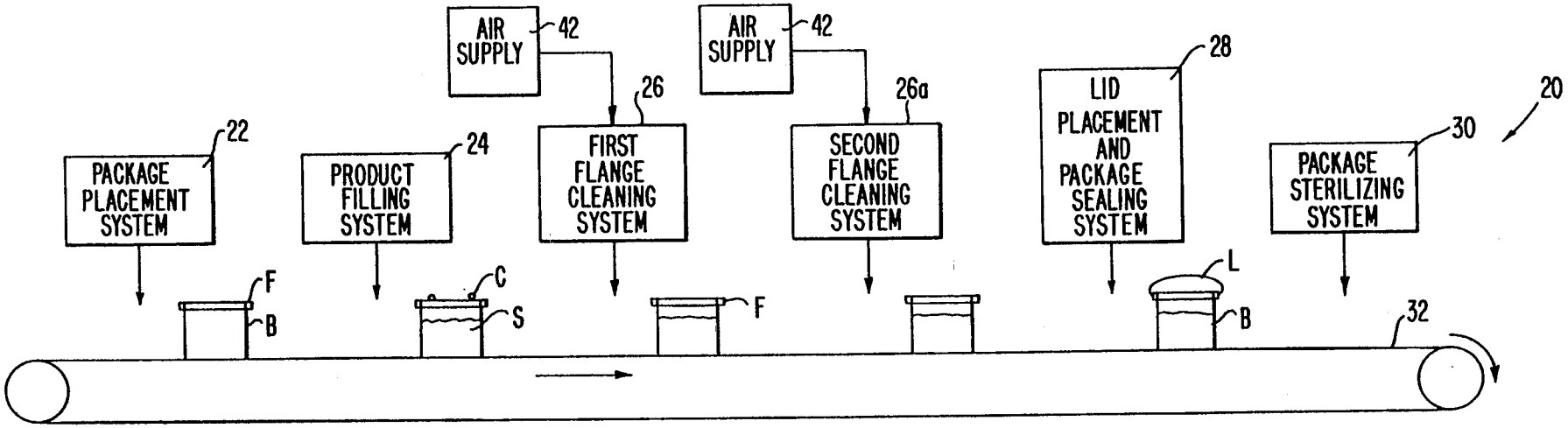
FIG. 9 is a schematic view of a third filling and sealing system of the present system.

Accordingly, referring to FIG. 9, another embodiment of the present invention places two flange cleaners end-to-end on the machine (20) to thereby remove the droplets remaining on the flanges F. Although an efficient cleaning could be obtained by reversing the conveyor 32 and running the bowl B through the cleaning device 26 a second time, the second flange cleaner **26*a* is more efficient as the line can be kept running continuously. In other words, since large product drippage cannot be removed with a single pass under the cleaner apparently, a tandem two-cleaner system (26**) is preferred for many applications.

Although the cleaning system 26 of the present invention is pictured installed on a FEMCO machine, it is also within the scope of the present invention to install it on a GASTI machine. The GASTI machine is a dual line arrangement with two containers (B) per pallet (P) in a six-pack setup, as previously discussed. The flange cleaner 26 can be easily adapted for the GASTI machine. The manifold thereof 40 would simply be lengthened and instead of one template, two templates 50 would be used for the dual line.

The flange contaminant remover or cleaning system 26 of the present invention precisely eliminates contaminants C by tracking with a needle-like focused air stream on the seal areas F of the container B while not disturbing the high fill level of the product S. This pattern can be adapted for any flat, rigid or sloped flange surface or any combination thereof. An example of a container B usable according to this system is the known crockpot-shaped containers with ears or handles on both sides. The crockpot version is expensive to manufacture though, and thus square or round flanges, similar to a regular soup dish or bowl, may be preferred. The soup cups or bowls can be made of plastic, glass or other suitable material.

The air manifold 40, located inside of the rotating sleeve 54, as previously stated, allows pivoting to any perpendicular angle in the travel direction T of the containers B. This allows removal of droplets or particulates P in a reverse direction without contaminating the flanges F previously cleaned. The device 26 can be used not only in a continuous motion as previously described, in singular or multiple product lanes, but also in an intermittent system.

An intermittent system of this invention is shown in FIG. 8 generally at 96. Referring thereto, it is seen that this system can be adapted to an indexing line by using a stationary flathead 98. The filled container B is located under the fixed head 98, that is, a template manifold, while a downward blast of clean compressed air blows the contaminants C off. In other words, the template comprises a flat surface and a series of orifices or slots 100 passing therethrough above the package B. The package B is stationary for a predetermined amount of time under the head, the head comes down over the package B and blows the particulates C off and away from the package. Indexing systems, but without this present cleaning system, have been used for packaging and sealing pickles for example.

From the foregoing detailed description, it will be evident that there are number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the pending claims. i

What is claimed is:

1. A contaminant removal method, said method comprising the steps of:

conveying to a new location product filled containers having flange seal areas;

during said conveying step, directing a downward stream of pressurized fluid which tracks the seal areas of the conveyed filled containers as they are being conveyed by focusing said stream onto said seal areas so that said stream follows the configuration of said seal areas to thereby blow contaminants off of the seal areas and generally without disturbing the product filled in the containers by preventing said stream from blowing directly into said containers; and thereafter, sealing the containers on their seal areas.

2. The method of claim 1 further comprising, thereafter, sterilizing the filled and sealed containers.

3. The method of claim 1 further comprising, the downward stream defining a first downward stream, and before said sealing step and after said directing step, directing a second downward stream of pressurized air and thereby blowing generally all remaining contaminants off of the seal areas.

4. The method of claim 1 wherein said flange seal areas are generally horizontal.

5. The method of claim 1 wherein said flange seal areas have a generally circular configuration.

6. The method of claim 4 wherein said directing step includes directing the downward stream of pressurized fluid vertically downward onto said generally horizontal flanges.

7. The method of claim 1 further comprising applying lids to the containers after contaminants have been blown off of said flange seal areas.

8. The method of claim 1 wherein said seal areas are tracked by directing said stream to a rotating sleeve having a pattern of orifices disposed in front of said downward stream of pressurized fluid such that said downward stream passes through said rotating orifices.

9. The method of claim 8 wherein said pattern of orifices corresponds with the configuration of said seal areas.

10. The method of claim 1 wherein said directing step includes selectively directing the downward stream of pressurized fluid to blow the contaminants outwardly away from the interior of said product filled containers.

11. The method of claim 1 wherein said directing step includes the downward stream of pressurized fluid continuously tracking said seal areas.

12. The method of claim 1 wherein said directing step occurs while said product filled containers are moving.

13. The method of claim 1 wherein said preventing step includes rotating a template in front of said downward stream, said template having a pattern of orifices disposed about an impervious central portion of said template, said impervious central portion blocking said downward stream from blowing into said container.

14. A contaminant removal method, said method comprising the steps of:

conveying to a new location product filled containers having flange seal areas;

during said conveying step, rotating a sleeve having a pattern of openings above said product filed containers at a rate corresponding to the rate at which the containers are conveyed, such that said pattern tracks the configuration of the seal areas; and blowing a pressurized fluid through said pattern of openings such that said fluid blows contaminants off of said seal areas and is prevented from blowing directly into said containers; and thereafter, sealing the containers on their seal areas.

15. The method of claim 14 further comprising applying lids to said container after contaminants have been blown off of said flange seal areas.

16. The method of claim 14 wherein said blowing step includes forming a narrow curtain of pressurized fluid such that portions of said curtain pass through said pattern of openings.

* * * * *